United States Patent [19]

Barnett et al.

[11] Patent Number: 4,536,890

[45] Date of Patent: Aug. 27, 1985

[54] GLOVE FOR LOW PARTICULATE ENVIRONMENT

[75] Inventors: Steve M. Barnett, Glencoe, Ill.; Michael A. Flowers, Ontario, Calif.; John A. Varos, Willard, Ohio

[73] Assignee: Pioneer Industrial Products Company, Willard, Ohio

[21] Appl. No.: 581,691

[22] Filed: Feb. 21, 1984

[51] Int. Cl.[3] ..... A41D 19/00

[52] U.S. Cl. ..... 2/164; 2/161 R; 2/168

[58] Field of Search ..... 2/164, 158, 159, 161 R, 2/162, 167, 168

[56] References Cited

U.S. PATENT DOCUMENTS

| | | | |
|---|---|---|---|
| Re. 18,058 | 5/1931 | Bradley et al. | 36/7.3 |
| 1,157,646 | 10/1915 | Miller | 2/168 |
| 1,699,495 | 1/1929 | Sturm . | |
| 1,725,065 | 8/1929 | Edwards . | |
| 2,083,684 | 6/1937 | Burke . | |
| 2,096,412 | 10/1937 | Sturm | 2/161 R |
| 2,217,377 | 10/1940 | Moore . | |
| 2,446,921 | 8/1948 | Grant . | |
| 2,632,171 | 3/1953 | Kuh . | |
| 3,268,647 | 8/1966 | Hayes et al. | 2/168 X |
| 3,541,609 | 11/1970 | Povlacs et al. | 2/168 |
| 3,548,413 | 12/1970 | Jackson | 2/164 X |
| 3,801,988 | 4/1974 | Marcum, Jr. et al. . | |
| 4,283,244 | 8/1981 | Hashmi . | |
| 4,399,567 | 8/1983 | Joong | 2/161 R |

*Primary Examiner*—Werner H. Schroeder
*Assistant Examiner*—J. L. Kravitz
*Attorney, Agent, or Firm*—Marshall, O'Toole, Gerstein, Murray & Bicknell

[57] ABSTRACT

A glove for use in a low particulate environment, such as a manufacturing area for electronic equipment, has an external shell composed of polyvinyl chloride or elastomeric material. The external shell has a hand portion and a gauntlet portion. The hand portion is internally lined with flock while the gauntlet portion is unlined.

5 Claims, 2 Drawing Figures

GLOVE FOR LOW PARTICULATE ENVIRONMENT

BACKGROUND OF THE INVENTION

The present invention relates generally to gloves and more particularly to gloves for use in a low particulate environment.

A low particulate environment is desirable in an area where electronic equipment is manufactured, for example. Manufacturing and assembly workers in such an area generally wear protective garments, such as caps, smocks or gowns and gloves. The glove has an external shell typically composed of polyvinyl chloride (PVC) or elastomeric material such as natural rubber or synthetic rubber. Such gloves are much more acceptable to the workers who must wear them if the gloves have an internal lining composed of fibrous material such as cotton flock. Flock is composed of finely divided, ground, fibrous particles which are applied as a lining by spraying the flock particles onto an adhesive-covered backing (e.g., the external shell of the glove), for example.

An internal glove lining composed of flock provides a smooth, comfortable feel, cushions the hands, absorbs perspiration and keeps the hands dry, insulates against moderate heat and cold without bulk, makes it easier to put on and take off a glove, and has other advantages which increase worker acceptance of a glove.

A drawback to a glove having an internal lining composed of cotton flock (or like fibrous material) is that particles thereof may become detached from the internal lining by abrasion with the surface of the sleeve on the smock or gown worn by the glove wearer or by abrasion with the hand of the glove wearer, and these detached particles can migrate out of the glove, particularly when the glove is removed from the hand of the wearer. In a low particulate environment, such as an assembly area for electronic equipment, migration of detached particles out of the glove is undesirable because it increases the particulate content of the environment.

Elimination of the lining from the glove is not a viable alternative because the glove wearers are reluctant to accept gloves without such an internal lining.

SUMMARY OF THE INVENTION

A glove constructed in accordance with the present invention avoids the problems discussed above. The glove comprises an external shell composed of polyvinyl chloride or elastomeric material. The shell comprises a hand portion for enclosing the hand of a glove wearer and a gauntlet portion for enclosing the wrist and the lower forearm of the glove wearer. An internal lining is attached to the inside surface of the hand portion, only.

The internal lining is composed of textile material, such as cotton flock, from which particles can be detached by abrasion with the surface of the sleeve of an article of clothing worn by the glove wearer. Such abrasion is avoided, however, because the inside surface of the gauntlet portion of the shell is devoid of any lining from which such particles may become detached, and the lining attached to the hand portion of the shell does not abrade against the sleeve.

Although it is possible for flock particles to be otherwise detached from the lining at the hand portion of the shell, these detached particles must migrate the entire length of the unlined gauntlet portion before they can escape to the outside of the glove, and the gauntlet portion has a length sufficient to minimize the likelihood of such an escape. Because the lining is confined to the hand portion of the external shell, it is less likely that particles will migrate out of the glove than if a larger part or all of the glove were so lined.

The net result is a reduction of approximately 50% in the amount of particles which may enter the environment from a glove in accordance with the present invention, compared to a glove in which the entire external shell has a lining composed of fibrous material such as flock.

Other features and advantages are inherent in the glove claimed and disclosed or will become apparent to those skilled in the art from the following detailed description in conjunction with the accompanying diagrammatic drawing.

DETAILED DESCRIPTION

Figure 1:
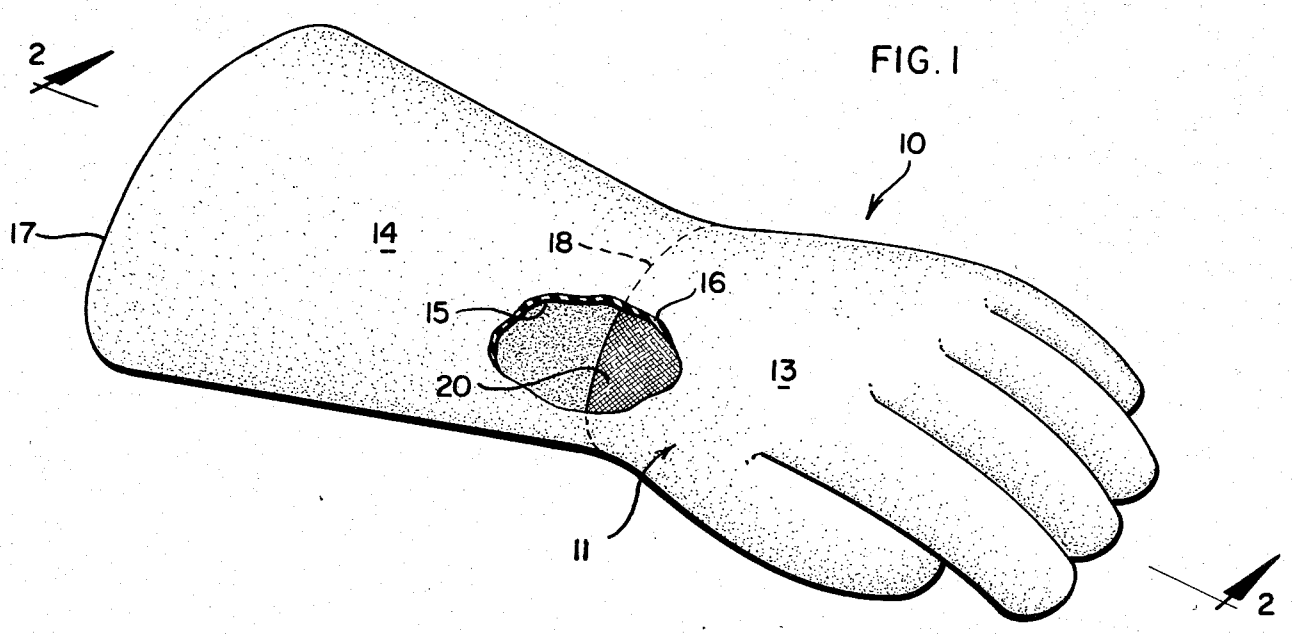
FIG. 1 is a perspective, partially in section and partially cut away, illustrating an embodiment of a glove constructed in accordance with the present invention.
Figure 2:
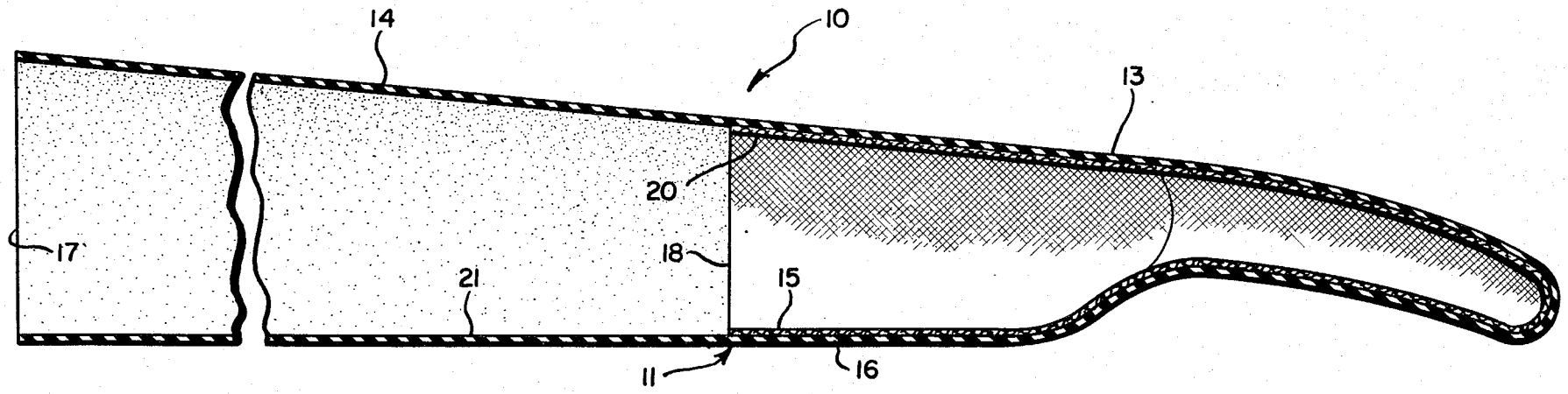
FIG. 2 is an enlarged sectional view taken along line 2—2 in FIG. 1.

Indicated generally at 10 is a glove constructed in accordance with an embodiment of the present invention. Glove 10 comprises an external shell 11 composed of polyvinyl chloride or an elastomeric material such as natural rubber, synthetic rubber, blends of natural and synthetic rubbers or the like.

External shell 11 comprises a hand portion 13 for enclosing the hand of the glove wearer and a gauntlet portion 14 for enclosing the wrist and the lower forearm of the glove wearer. Gauntlet portion 14 extends from an open rear entrance 17 of glove 10 to a location 18 corresoonding substantially to the forward end of the wrist of the glove wearer.

External shell 11 has an inside surface 15 and an outside surface 16. Attached to inside surface 15 of the external shell's hand portion 13 is an internal lining 20. The inside surface of gauntlet portion 14 is devoid of any such lining.

Internal lining 20 is composed of a fibrous material such as flock. The flock may be made from cotton or other natural fibers (e.g., wool or silk), synthetic fibers (e.g., polyester) or a blend of natural and synthetic fibers.

Flock is a material from which particles may become detached by abrasion with the surface of a sleeve of an article of clothing, such as a gown or smock, worn by the glove wearer. This would be a problem in a low particulate environment, but the problem is avoided in accordance with the present invention because the inside surface 21 of gauntlet portion 14 is devoid of any lining from which such particles may become detached.

Moreover gauntlet portion 14 has a length, from location 18, at the forward end of the wrist of a glove wearer, to open rear glove entrance 17 which is sufficient to minimize the likelihood of escape of detached flock particles originating at lining 20 attached to hand portion 13 of external shell 11. More particularly, glove 10 typically has a length of about 14 inches (356 mm), and the gauntlet portion of the glove has a length within the range 5–7 in. (127–178 mm). Preferably, the gauntlet portion is 6 in. long (152 mm).

Gauntlet portion 14 encloses preferably at least the lower half of the forearm of the glove wearer. If desired, the gauntlet portion may extend further up the forearm. In some embodiments, gauntlet portion 14 may enclose less than the lower half of the forearm so long as the unlined gauntlet portion has sufficient length to substantially impede migration out of the glove of detached flock particles originating at the hand portion of the glove.

Because internal lining 20 is confined to hand portion 13 of external shell 11, there will be no abrasion between lining 20 and the surface of a sleeve on an article of clothing worn by the glove wearer during the time the glove is being put on or taken off. In addition, because the rearwardmost edge 18 of lining 20 is so remote from open rear end 17 of glove 10, it is extremely unlikely that any particles originating at the hand portion 13 would migrate out of the glove through open rear end 17.

When gloves in accordance with the present invention are used, the maximum potential particulate burden of the surrounding environment is reduced by 50% compared to the particulate content of an environment in which are used gloves in which the internal lining is attached to the totality of the inner surface of the external glove shell.

A construction in accordance with the present invention may be employed not only when the internal lining of the glove is flock but in any situation employing an internal lining composed of fibrous material from which particles may become detached by abrasion with the surface of a sleeve on an article of clothing worn by the glove wearer or by abrasion at the hand portion of the glove.

Glove 10 may be manufactured employing a conventional operation for producing a glove having an external elastomeric shell and an internal lining composed of cotton flock, for example. In a typical operation, a form having the shape of the glove is dipped into a liquid coagulant for the elastomeric material which is then allowed to dry on the form which is then dipped into the liquid elastomeric material followed by a leaching operation in a hot water bath to remove from the elastomeric material undesirable, water soluble impurities. The elastomeric-covered form is then allowed to dry following which adhesive is applied to that part of the elastomeric material (e.g., hand portion 13) which is to be lined. Adhesive is applied by dipping the elastomeric-covered form in liquid adhesive up to the location of line 18. Flock is then applied by spraying. The flock will adhere only to that part of the elastomeric material covered with adhesive. The assembly is then subjected to a heating operation to vulcanize the elastomeric material, following which the glove is stripped from the form and inverted. The glove may then be washed to remove any loose flock particles.

The foregoing detailed description has been given for clearness of understanding only, and no unnecessary limitations should be understood therefrom, as modifications will be obvious to those skilled in the art.

We claim:

1. A glove for use in a low particulate environment, said glove comprising:

an external shell composed of a material selected from the group consisting of polyvinyl chloride and elastomeric materials;

said external shell comprising a hand portion for enclosing the hand of a glove wearer and a gauntlet portion for enclosing the wrist and the lower forearm of the glove wearer;

said external shell having inside and outside surfaces;

and an internal lining attached to the inside surface of said hand portion;

said internal lining being composed of fibrous material, said fibrous material being of a kind from which particles may become detached if there were abrasion between said material and the surface of a sleeve on an article of clothing worn by the glove wearer;

the inside surface of said gauntlet portion being devoid of any lining from which said particle may become detached.

2. A glove as recited in claim 1 wherein:

said lining is composed of flock made from the group consisting of natural fibers, synthetic fibers and blends thereof.

3. A glove as recited in claim 1 wherein:

said gauntlet portion has a length which minimizes the likelihood of escape of detached particles originating at the lining attached to the hand portion of said external shell.

4. A glove as recited in claim 3 wherein:

said gauntlet portion has a length within the range 5–7 inches (127–178 mm).

5. A glove as recited in claim 1 wherein:

said gauntlet portion extends from an open rear entrance of the glove, corresponding to a location at least halfway up the forearm of a glove wearer, to a location corresponding substantially to the forward end of the wrist of a glove wearer so as to substantially impede migration out of the glove of detached lining particles originating at the lining attached to the hand portion of said external shell.

* * * * *